US005361885A

United States Patent [19]

Modler

[11] Patent Number: 5,361,885

[45] Date of Patent: Nov. 8, 1994

[54] ANTICOUNTERFEITING DEVICE FOR GAMING CHIPS

[76] Inventor: Peter Modler, 3359 Wade, Los Angeles, Calif. 90066

[21] Appl. No.: 21,053

[22] Filed: Feb. 23, 1993

[51] Int. Cl.[5] ..... G07F 7/00

[52] U.S. Cl. ..... 194/214; 40/27.5

[58] Field of Search ..... 194/214, 205, 212, 213; 453/4; 40/27.5; 273/238, 290

[56] References Cited

U.S. PATENT DOCUMENTS 3,953,932 5/1976 Graves ..... 40/27.5

4,026,309 5/1977 Howard ..... 194/214

*Primary Examiner*—F. J. Bartuska

*Attorney, Agent, or Firm*—Price, Gess & Ubell

[57] ABSTRACT

An interchip for implantation into a gaming chip or token provides a circular array of light-receiving faces arrayed about the circumference of the chip or token. Light received by one face is conducted to the remainder of the faces by a number of internal fingers which communicate light to and from a central portion. The number of fingers and, hence, faces is selected to reflect the value and, hence, authenticity of the chip or token. Racks of such chips may be scanned or illuminated to detect their value or authenticity.

11 Claims, 2 Drawing Sheets

ANTICOUNTERFEITING DEVICE FOR GAMING CHIPS

BACKGROUND OF THE INVENTION

1. Field of the Invention

The subject invention relates to gaming devices and, more particularly, to an anticounterfeiting device for gaming chips, typically used in casinos.

2. Description of Related Art

The use of counterfeit chips to defraud gaming establishments is a continuing problem. In a typical scheme, a counterfeit chip is exchanged for an authentic chip of high value, for example, $10,000, $20,000, or even $50,000, and the authentic chip cashed in. Because of the simple nature of typical gaming chips, they are relatively easily counterfeited. Various efforts to combat counterfeiting have been employed. These have included the use of chips of specially-selected colors, application of universal product codes or bar codes to the chips, holographic designs, and the employment of special computer chips embedded in the gaming chips. A universal problem with these various techniques is that only one chip at a time can be examined to discern whether it is authentic. Various methods are also expensive or impractical to implement. For example, the implementation of relatively inexpensive and small computer chips in gaming chips is impractical because the computer chips are destroyed by the high temperatures used in forming typical plastic gaming chips.

SUMMARY OF THE INVENTION

It is therefore an object of the invention to provide an improved anticounterfeiting device for use with gaming chips;

It is another object of the invention to provide such an anticounterfeiting device which permits examination of a group of such chips en masse to discern their authenticity; and It is another object of the invention to provide such an anticounterfeiting device which is readily and inexpensively manufactured.

According to the invention, a special interchip is provided, which may be embedded in plastic gaming chips or tokens during fabrication. The interchip is formed of a light-conducting material which conducts light to a plurality of fingers, each of which terminates and presents a lighted face at the edge of the chip. When light is shined at one point on the edge of the chip, the remaining fingers light up, and their number is an indication of the type and, therefore, the authenticity of the chip.

BRIEF DESCRIPTION OF THE DRAWINGS

The just-summarized invention will now be described in detail in connection with the drawings, of which.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a particularly useful and readily manufacturable interchip embodiment.

Figure 1:
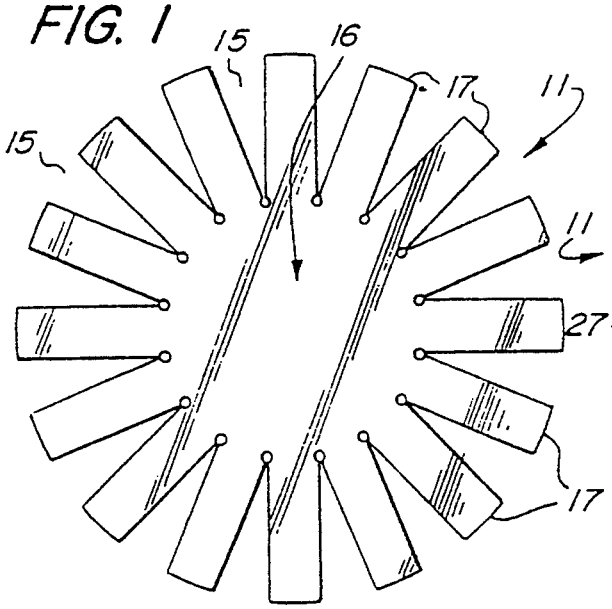
FIG. 1 is a top view of an interchip according to the preferred embodiment.

FIG. 1 illustrates an interchip including a centroid portion 16 and a number of rectangular fingers or spokes 17 extending therefrom. The centroid 16 shown in FIG. 1 is generally circular, and the fingers or spokes 17 extend radially from the periphery or circumference of the centroid 16. The centroid 16 could, of course, be various other geometrical shapes consistent with the desired functions hereafter described in more detail.

The interchip 11 is preferably planar and of a uniform thickness, for example, 0.010-inch thick. Its outside diameter may be, for example, 1.590 inches, the diameter of a typical casino chip. The interchip may be manufactured from Mylar TM, made by DuPont, any Mylar TM -based resin, a plexiglas resin, a phenolic resin, glass, or any other translucent material which will distribute light received by one finger 17 to the other fingers 17, as described in more detail hereafter.

Figure 2:
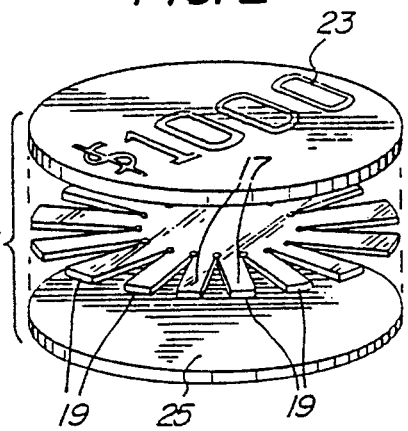
FIG. 2 is an exploded perspective view illustrating implantation of an interchip according to the preferred embodiment.
Figure 3:
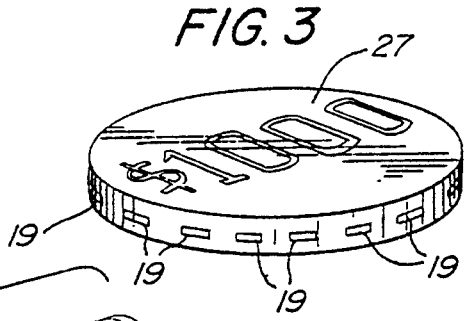
FIG. 3 is a perspective view illustrating the preferred embodiment.

As shown in FIG. 2, the interchip 11 is implanted within a conventional chip or token 27. In FIG. 2, the chip or token 27 has been split into two halves, 23, 25, to illustrate the placement of the interchip 11. Once implanted, only the faces 19 of the fingers 17 of the interchip 17 are visible, distributed around the edge of the chip or token 27. The faces 19 may, in fact, lie slightly beneath a very thin layer of the conventional chip material.

When implanted, the interchip 11 tends to take on the color of the chip or token 27. This factor, together with its thin cross-section of, e.g., 0.010-inch, makes the interchip 11 very difficult to detect when in place.

In basic operation, when light shines on one of the faces 19 of the interchip 11, it illuminates all the interchip faces 19 distributed along the edge of the chip 27. The number of faces 19 can then be counted and used as an identifier of the type or dollar amount of the chip or token. By using a different number of fingers having different widths, the end user is able to determine the specific value of an individual chip or token 27. The number of fingers 17 may be viewed as a simple binary code that can be read by an electronic reading device.

The interchips 11 themselves may be readily manufactured by various known techniques, such as laser cutting or, more preferably, by being punched out by a punch press. This latter technique provides a roughened edge which enhances the visibility of the interchip pattern. The interchip 11 can be readily incorporated into the standard procedures for manufacturing casino chips or tokens out of plastic. Such techniques include injection molding or molding between two thixotropic plastic sheets. After the chips are fabricated with the interchip installed, the outside edge is preferably ground, again to provide greater visibility of the faces 19 of the fingers 17.

Figure 4:
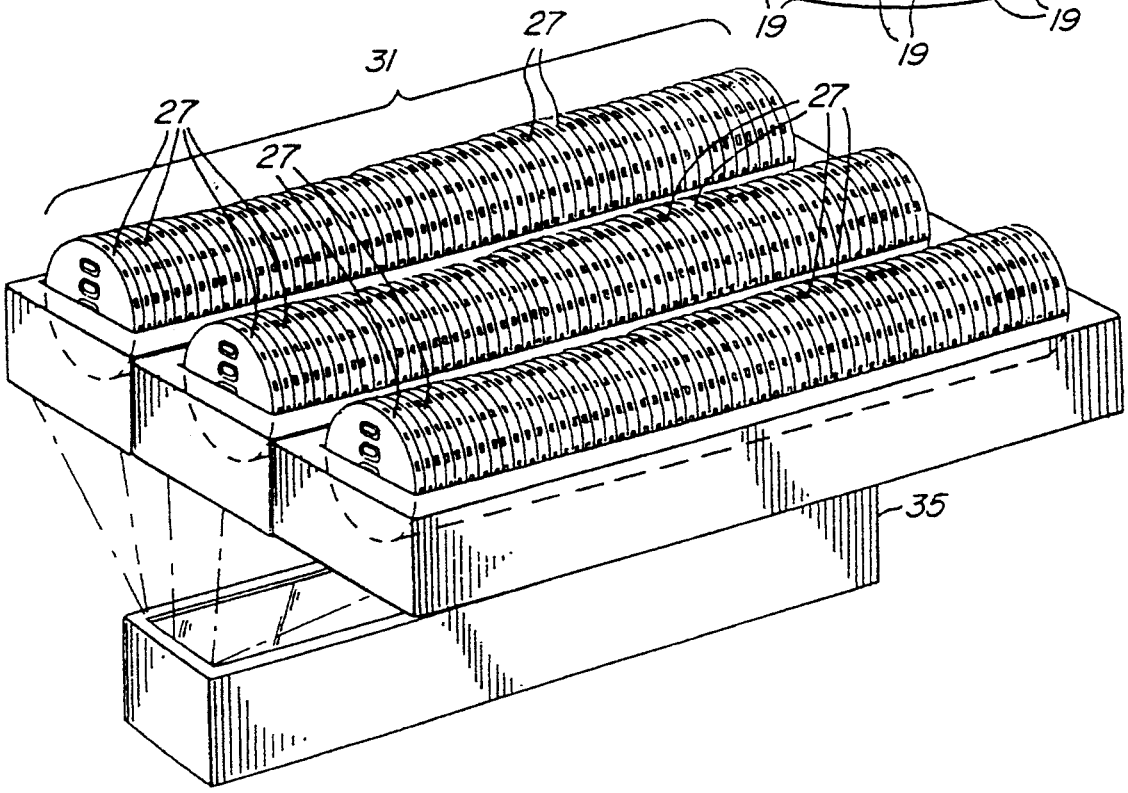
FIG. 4 illustrates a stack of chips or tokens employing the preferred embodiment.
Figure 5A:
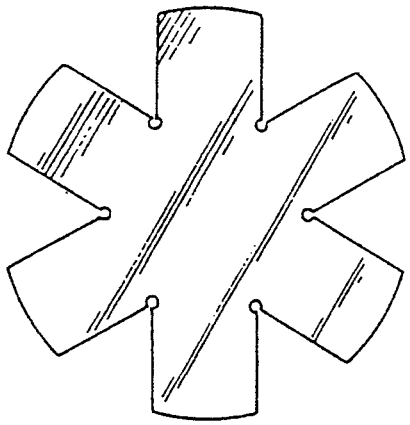
FIGS. 5A–5D illustrates various configurations of interchip devices according to the preferred embodiment.
Figure 5B:
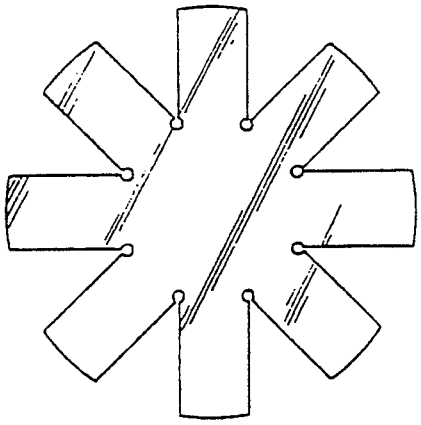
Figure 5C:
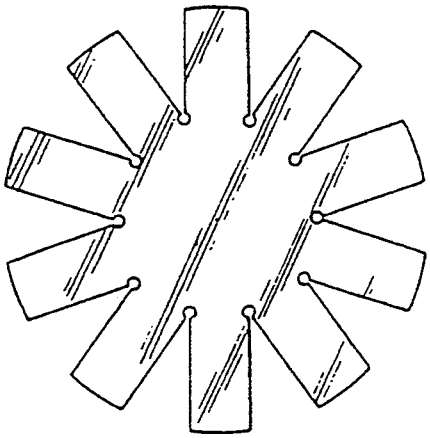
Figure 5D:
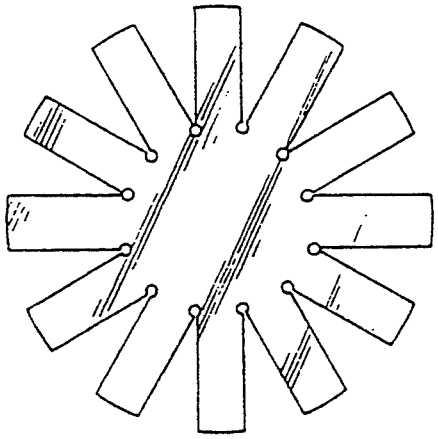

In a casino, chips 27 are typically contained in a rack, e.g., 33, as shown in FIG. 4. According to the embodiment of FIG. 4, a light source 35, such as a light box, may underlie a rack of horizontally-disposed chips 27. The denomination or authenticity of the chips 27 may then be readily ascertained by viewing the faces 19. In the embodiment of FIG. 4, light enters the interchip 11 of each chip through one or more of the faces 19, travels through the interchip 11, and exits through the other faces 19, enabling a visual recognition of authenticity.

Chips 27 including the interchip 11 may also be vertically stacked and similarly backlit. A scanner mechanism may be provided to scan chips 27 including respective interchips 11 to determine their value or authenticity. The preferred embodiment may find application in various gaming situations, as well as other areas where tokens are used, for example, such as subways or tollways.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An anticounterfeiting device for implantation within a chip or token comprising:

a generally planar central light-conducting portion; and a plurality of light-conducting fingers extending from said central light-conducting portion in a generally planar relation to said central portion, each finger terminating in a respective light-receiving face, such that light received by a face of one of said fingers is transmitted through said central portion to the faces of each of the remaining fingers.

2. Apparatus comprising:

a generally flat token having a peripheral edge;

an implant device embedded in said flat token; said implant device including a light-conducting central portion and a plurality of fingers each having a light-receiving end face and extending generally radially from said central portion so as to present a plurality of faces arrayed along said edge, said fingers further being formed of light-conducting material such that light applied to one of said faces illuminates the remainder thereof.

3. The apparatus of claim 2, wherein said flat token is disc-shaped and wherein said periphery is circular.

4. The apparatus of claim 3, wherein said central portion is circular and said fingers comprise a plurality of spokes extending from said central portion.

5. A system comprising:

a plurality of gaming chips of generally circular configuration, each having a peripheral edge;

means embedded in each of said gaming chips for presenting a plurality of light-receiving faces about said peripheral edge of said chip and for conducting light received at one of said faces to illuminate the remainder of said faces;

rack means for retaining said chips in a stack; and light source means for illuminating a plurality of said chips.

6. The system of claim 5, wherein said peripheral edge is circular.

7. The system of claim 6, wherein said means presenting a plurality of light-receiving faces comprises a plurality of light-conducting fingers.

8. Apparatus comprising:

a gaming chip having top and bottom surfaces and a peripheral edge; and means embedded in said gaming chip for presenting a plurality of light-receiving faces about said peripheral edge of said chip and for conducting light received at one of said faces to illuminate the remainder of said faces.

9. Apparatus comprising:

a generally flat disc-shaped token having a center and a circular peripheral edge disposed at a selected radius from said center;

an implant device embedded in said flat token; said implant device including a light-conducting, disc-shaped central portion of a radius less than the radius of said token, said central portion being located concentrically with said token; and a plurality of fingers extending generally radially from said central portion so as to present a plurality of faces of rectangular cross-section spaced at equal intervals along said edge, said fingers further being formed of light-conducting material such that light applied to one of said faces illuminates the remainder thereof, said fingers and light-conducting central portion further lying in coplanar relationship with one another.

10. The apparatus of claim 9, wherein said edge is translucent and said faces each lie beneath said edge such that they are concealed from view unless said edge is exposed to illumination.

11. The apparatus of claim 9 wherein said implant device is constructed of a material which causes it to take on the color of said token.

* * * * *